US008485453B2

(12) United States Patent
Efremkin et al.

(10) Patent No.: US 8,485,453 B2
(45) Date of Patent: Jul. 16, 2013

(54) DRINKING STRAW

(76) Inventors: Pavel V. Efremkin, Ardsley, NY (US); Liudmila V. Gruzdeva, Moscow (RU)

( * ) Notice: Subject to any disclaimer, the term of this patent is extended or adjusted under 35 U.S.C. 154(b) by 0 days.

(21) Appl. No.: 13/200,234

(22) Filed: Sep. 20, 2011

(65) Prior Publication Data

US 2012/0012598 A1 Jan. 19, 2012

Related U.S. Application Data

(62) Division of application No. 11/999,248, filed on Dec. 3, 2007, now Pat. No. 8,025,242.

(51) Int. Cl.
*A61J 15/00* (2006.01)
*A47G 21/18* (2006.01)

(52) U.S. Cl.
USPC ..... 239/33; 239/24; 239/16

(58) Field of Classification Search
USPC ..... 239/33, 24, 16, 132
See application file for complete search history.

(56) References Cited

U.S. PATENT DOCUMENTS 3,260,462 A * 7/1966 Smaczny ..... 239/33
5,431,297 A * 7/1995 Rosello ..... 220/706
5,507,156 A * 4/1996 Redmon ..... 62/400
5,819,979 A * 10/1998 Murphy et al. ..... 220/706
6,945,425 B1 * 9/2005 Kim ..... 220/706

* cited by examiner

*Primary Examiner* — Dinh Q Nguyen
(74) *Attorney, Agent, or Firm* — Lawrence G. Fridman

(57) ABSTRACT

The straw designed for the intake of water based drink from a container. In the lower part of the flexible straw there are holes that are connected to the main tube of the straw. Above the holes and attached to the straw, there is a floating device which allows for the intake of the drink from the container only from fixed depth ranges, preferably from 5-15 mm from the surface of the water. The straw allows for the protection of the organism of the user from negative effects of the drink on the body's cells.

16 Claims, 5 Drawing Sheets

DRINKING STRAW

This is a Divisional Application of U.S. patent application Ser. No. 11/999,248 filed on Dec. 3, 2007 now U.S. Pat. No. 8,025,242.

PREVIOUS ART. BACKGROUND OF THE INVENTION

1. Field of the Invention

This invention relates to a drinking instrument. Particularly, this invention describes the construction of the straw as it pertains to the sucking in (extracting) of a water based drink from a container.

2. Description of the Prior Art

In modern science it is known that water may have different properties in different layers and depths. Thus there may be a need for a drinking straw device, which may allow for the extraction of a drink consistently from a certain predetermined depth.

In previous art there exists a straw with a number of holes along its length (U.S. Pat. No. 2,570,366, 1951). The holes in this straw can open and close before the straw is submerged in a liquid. When one of the holes is opened the liquid will be sucked from that point, however since this intake of liquid will affect the levels of the entire liquid, it will be impossible to take all or majority of the liquid from a certain depth.

There exists in previous art a straw that has a bobber attached to it. The lower end of the straw is bent to a certain angle (JP 2005013684, 2005). The liquid is sucked up through the straw using the intake opening at the end of the straw. Based on these parameters it is clear that the liquid can only be sucked in through one opening and therefore it will result in the creation of a turbulent flow, which in turn will cause layers of liquid located above and below the opening of the straw to be sucked in as well. Because of that, this design of the straw cannot be used effectively to suck in liquids from a certain depth or layer as determined by the placement of the lower end of the straw.

There exists in previous art a straw with a bobber-filter on its end (DE 20 2006 000 080 U, 20 Apr. 2006). When this type of straw is used, the intake flow that enters the straw collects the liquid from a conical area that has a top at the end of the straw, therefore also making it ineffective to take in liquids from a certain depth level based on the placement of the lower end of the straw. There exists in previous art a straw with an ice catcher at the end of the straw (US 2004118769, 2004). The liquid enters the straw through the ice pieces in the catcher. Like with the previous two types of straws the drink liquid cannot be consistently taken in from a specific and predetermined depth.

3. Background of the Invention

This invention was created based on the results of experiments performed to study the properties of water and how they affect the living cells of an organism.

Water is the principle component of any water based drink (including cocktails). It is known that molecules of water have the shape of tetrahedron there are two positive and two negative charges (the magazine Chemistry and Life, No. 11, 1991). In liquid form the molecules of water (based on the laws of interaction of charged particles) form connections, called clusters (Schwartz Cl. E. Unusual Physics of Common Phenomena M. Nauka, 1986). Clusters are constantly being formed due to the opposing charges in the molecule and are broken (Schwartz Cl. E. Unusual Physics of Common Phenomena M. Nauka, 1986; U.S. Pat. No. 2,124,681 C1, 1999) due to the effects of outside forces (molecules with energy that exceeds the energy of the hydrogen bonds: quanta of light, electromagnetic radiation, etc). Clusters of water molecules form chains similar to the chains formed by iron fillings in a magnetic field. In a chain of water molecules (formed on the electrical connections of the charged dipoles) the more electrically active areas are located at the ends of such a chain. Therefore the shorter chains are more electrically active as there are more active ends present in the water. The reverse is also true, that the longer the chains are, the less electrically active they are as there are less ends available and therefore the volume of water is less electrically active as well. These active ends are the things that affect the living cells when the cells are in contact with water. And as experiments show, more active water may accelerate cells growth or other forms of cellular development. While in some cases such acceleration of cellular processes may be advantageous, for example as it discussed below in relation to a seed germination, for a developed human tissue, such acceleration may not be advantageous as it may lead to the premature ageing. Hence, it may be beneficial to find ways to minimize the external electrical stimulation effect of active water when it is consumed in drinks, thus creating a situation where the cells can develop without external effect from the water, so as to prevent any type of accelerated growth that would cause a premature aging within the cell.

SUMMARY OF THE INVENTION

The current invention was designed based on the testing of the activity levels of water by using various types of water to germinate seeds and measuring the required time for the seeds to germinate. Particularly, the water was taken from different depth levels from a container. These experiments showed that water taken at depths of 5 to 15 mm from the surface results in lower germination rates and therefore is less active. This effect of the "lowered germination rates" increases up to 1.5 times compared to the previously stated levels if the water is covered with pieces of ice. This effect increases up to 2 times if the top layer of water is taken from a silver container. This effect holds constant for the water taken from the depths of 5 to 15 mm even with lowered levels of water due to previous sampling.

It is known that the activity of water depends on the manner in which it was obtained: rain water, ice water, and water from underground sources. Rainwater is considered more active than the other two water types. For example seeds that are grown in rainwater germinate faster than in other types of water. In essence, this type of water interacts better with the cells of the seed, causing a faster germination and growth, but therefore faster death. If we wish to prolong cell life for as long as possible in humans, we should not imbibe this type of water as we do not want to accelerate cell processes which might result in premature wearing and aging of cells. Ice water, or water from ice, is naturally less active because it comprise of larger clusters formed by longer chains of water molecules, which therefore results in a less electrically active water. Hence ice water has a minimal effect on the body and has the ability to prolong the life of our bodies; that is why it is added to the water drinks in the form of ice.

However even ice water shows substantially reduced activity if it is taken from the depth of 5 to 15 mm (as shown in the table of experimental results below). Experiments also show that an additional reduction of water activity levels can be achieved if the internal surface of the water container is coated with silver or another type of water wettable substance. The mechanism of the reduction of the activity of the water in a silver coated container may be explained by the silver coating absorbing the extra electrical charge from the water clusters when water molecules come in contact with it.

The experiments described below illustrate the fact that the activity of water depends on the depth of the water layer that it was taken from. In the table below there is information about the growth of the seeds depending on which type of water was used to germinate them. The number of seeds that germinated is presented as a percentage of seeds that did germinate from the whole. The water for germination was taken from a glass container from water depths of 1 mm, 2 mm, 5 mm, 10 mm, 15 mm, 17 mm, and 20 mm. There were three types of water used in the experiment: type A—fresh drinking water from a plastic bottle, poured into a glass container, type B—the same setup except with the addition of small pieces of ice, type C the same setup as in type A except the water is poured into a silver cup. The water was at room temperature. All of the seeds were in the different types of water for twenty-four hours at the same room temperature and humidity.

Table of percents of germination of seeds

| | Type of water | | |
|---|---|---|---|
| depth of water level | A | B | C |
| 1 mm | 90% | 60% | 55% |
| 2 mm | 90% | 55% | 55% |
| 5 mm | 65% | 45% | 35% |
| 10 mm | 55% | 45% | 30% |
| 15 mm | 65% | 50% | 50% |
| 17 mm | 72% | 70% | 60% |
| 20 mm | 75% | 65% | 70% |

Based on the table (based on the percentages of germination) the water level at the depth of 5-15 mm from the top of the water has the lowest activity levels. Therefore the affect of this water on a cell will be minimal, thus prolonging the life of the cell. In addition, it shows that the least water activity is achieved at the above stated depth levels, when the water is covered by ice and the internal surface of the container is coated with silver. It is important to note that such water conditions are not good for harmful bacteria to grow in, which adds additional benefits to it when used in drinks. This invention is intended to create a method and devices which will allow for water (or a drink) to be taken from a container in such a way that the extracted water has minimal biological activity so its affect on the cells of the organism will be minimal, thus reducing the risk of the premature aging of cells.

The purpose of this invention is to propose the optimal design of the straw to take water from a container from such a depth where the water in the drink has the lowest activity levels. This allows for an increased effectiveness of the body's defenses against a negative effect of the drink on the body's cells.

One aspect of the invention provides for a straw for water based drinks that is composed of a tube (straw), whose lower part is used for submersion in the drink and has a system of openings (holes) to suck in (take in) the drink from a certain depth and in an optimal laminar flow and to deliver it to the end user through the central tubing. The straw also includes a device (or fixture) to hold water in-take openings submerged at the certain predetermined depth from the drink's surface. The height of the lower part of the straw that has the aforementioned system of openings and the location of the device to hold openings submerged at a certain depth are chosen so as to allow the lower part of the straw with the openings to be constantly in an optimal position so as to allow for a laminar flow of the drink into the straw from the top layers of the drink at a depth of no more than 20 mm from the drink's surface.

Moreover the optimal placement of the device (or fixture) to hold water intake openings submerged at the certain predetermined depth from the drink's surface should be at a distance from the bottom of the straw so that the intake openings draw the water at a depth of 5-15 mm from the surface of the drink.

It is preferable to have the sum of total areas of the openings to take in the drink be greater than the cross-sectional area of the main tube of the straw. This will allow the intake flow of the drink to be laminar and to prevent the creation of the turbulent flow, which in turn will bring water from outside of the optimum range layers into the straw openings.

The openings for the intake of the drink from the container can be cut from the side walls of the lower part of the straw and located radially from the center vertical axis of the tube. These openings will connect to the inside of the tube. In this configuration the bottom part of the straw should be closed and have no openings.

There are different ways to position the drink intake openings.

- The openings may be located at one plane, perpendicular to the vertical axis of the tube and they may be equally or unequally spaced around the sides of the lower part of the straw
- The radial openings may be located in at least two planes perpendicular to the vertical axis of the tube; where the radial holes are located at least on one plane in equal distances while radial openings in other planes may be spaced unequally along the outer perimeter of the lower part of the straw
- It is also possible to make these radial openings in every plane spaced equally along the outside perimeter of the lower part of the straw. At the same time the openings located in one plane can be intersecting other planes in a checkerboard pattern
- Finally it is possible that the radial openings are located in at least one plane and are located unequally along the lower outside perimeter of the straw.

In another embodiment of the invention, it is proposed to have in the lower part of the straw fan shaped branches with openings to take in the drink from the container that are connected to the main tube of the straw. It is preferable that the sum of the area of the openings in the fan shaped branches was larger than the cross-sectional area of the main tube.

Yet in another embodiment of the invention, it is proposed to create a straw where the lower end of the straw is made of a porous material whose openings form holes for the intake of the drink. This porous end should be connected to the main tube.

Another aspect of the invention calls for the internal surface of the tube to be partially coated in silver, gold or another water wettable substance which may affect the properties of the water.

The device (fixture) to hold water in-take openings submerged at the certain predetermined depth from the drink's surface can be made in the form of an extrusion on the straw wall and making this part from a material that will float on surface of the drink.

In another embodiment of the invention, that extrusion is made as a hollow (donut shaped) body, which allows for the straw to float in the drink. Alternatively the hollow space can be filled with a substance, which floats in water and has a high heat capacity. This will allow the straw to be frozen before use, thus providing extra cooling to the drink taken through such straw. Above described extrusion or hollow body can be shaped as a disc, star or any other shape.

Another aspect of the invention calls for a piece (or layer) of ice can be placed on the outside surface of the extruded part of the straw. In addition there may be a picture in the ice that can be made out of food coloring. It is also preferable to have a picture in each layer of the multilayered ice disk, as when the ice melts there will be a new image, creating an effect of ever-changing pictures, similar to animation. It is also possible to add different food additives into the body of the ice which will be gradually released into the drink to provide different and changing tastes.

Yet another aspect of the invention, suggests that connection area between the upper tube part of the straw and the floating, extruded part is to be made either flexible, or in the form of a joint which will allow the upper part of the straw to be at any angle to the floating extruded part without pushing the floating part out of the drink. This is important to keep intake opening in the lower part of the straw always at the preferable depth of 5 mm to 15 mm.

Another aspect of the invention suggests to incorporate the above described type device into a large drink storage container used in restaurants, bars or in other multi user settings. Incorporating above described floating devices to extract drinks from a preferred depth of 5 mm to 15 mm into a larger storage-type drink container will allow for the filling the individual containers (glasses) with the less active water.

DESCRIPTION OF THE PREFERRED EMBODIMENT

Figure 1:
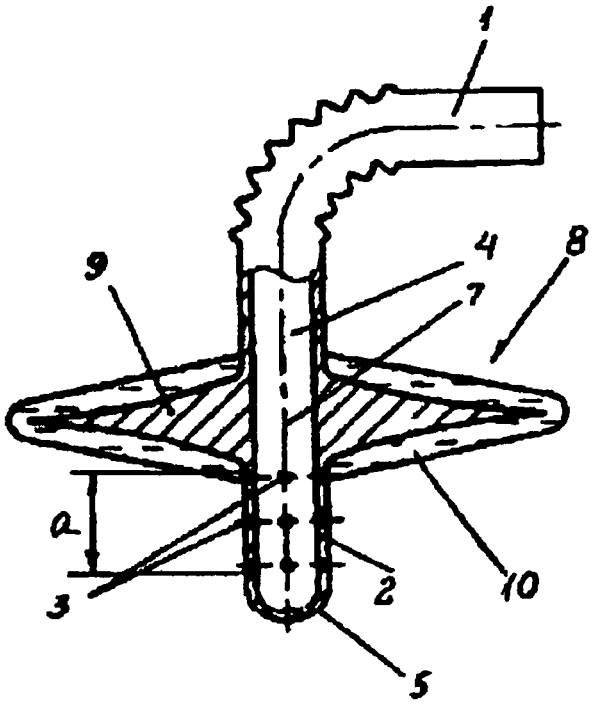
FIG. 1 shows the straw with a radially placed holes for the intake of the water with the device to hold water in-take openings submerged at the certain predetermined depth from the drink's surface

The new straw proposed in this invention is designed to allow one to consistently extract water drink from the depth layer between 5 mm to 15 mm from the drink surface. FIG. 1. shows the straw 1 comprised of the flexible upper tube delivering drink to the end user and the lower part of the straw 1, part 2 which is placed in the drink in the container (not shown). The cross section of the tube can have any shape including that of a ring.

The lower part of 2 of straw 1 has a system of openings 3 through which the drink is taken in from the container through the main tube 4 to the user. Those openings 3 are made so that the combined total area of the cross sections of these holes is greater than the cross section of the main tube 4 of the straw 1. This will allow for the maximum possible intake of the drink from the required depths of 5-15 mm. An optimum configuration of the openings 3 in the lower part 2 of the straw 1 will allow for a laminar flow from the drink into the straw. The placement of the holes and the reasons for their placement in relation to the flow of the liquid will be discussed later.

Figure 3:
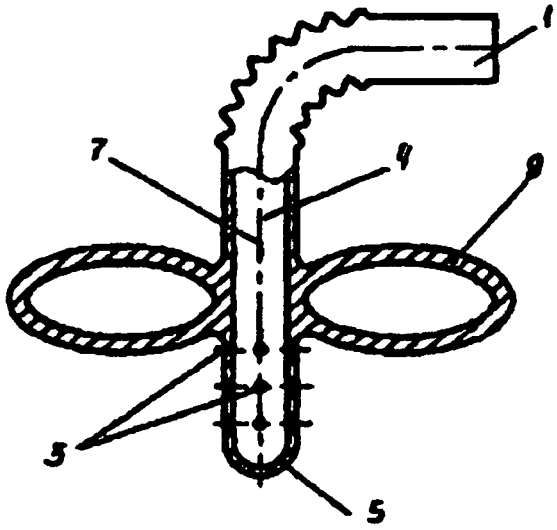
FIG. 3 shows the straw with a radially placed holes for the intake of the drink where the extrusion part is donut shaped.

In the embodiments shown in FIG. 1 and FIG. 3, the holes 3 for the intake of the drink from the container are cut in the side walls of the lower part 2 of the straw 1 and are connected to the main tube 4. The holes 3 are located radially in relation to the vertical axis of the main tube 4 of the straw 1 and are located all along the lower part of the straw. The lower end 5 of the straw 1 is closed.

There are many different ways to place the holes 3. They can be located in one plane, perpendicular to the vertical axis of tube 4 in straw 1. In this case the radial holes 3 can be placed equally spaced around the sides of the lower part 2 of the straw 1 (in this case the angles between the axes of close pairs is equal to all of the others). The holes 3 can also be placed unequally along the sites of the lower part of the straw (in this case the angles between the axis of the close pairs of holes are not equal).

As shown in FIG. 1 and FIG. 3 the radial holes 3 can be placed in any number (a minimum of two) of planes that are perpendicular to the vertical axis of tube 4 in straw 1. In this case the radial holes 3 can be equally spaced in at least one plane along the perimeter of the side of the lower part 2 of the tube 1. Those radial holes 3 that are located in the other planes are not spaced equally.

It is also possible to have the holes 3 in each of the planes to be equally spaced along the side of the lower part 2 of the straw 1). It is preferable to have the holes 3 that are in one plane intersect with holes 3 in another plane and have them form a checker board pattern. This pattern allows for a better flow of the drink into the main tube 4. This does not preclude the possibility of having the radial holes 3 in at least one plane being unequally spaced along the perimeter of the lower part 2 of the straw 1.

When one is determining the placement of the holes 3, it is important that the placement agree with the following rule: the holes have to cover a majority of the perimeter of lower part 2 in straw 1. This type of layout of the holes allows for a laminar flow of the drink during the use of the straw.

Figure 4:
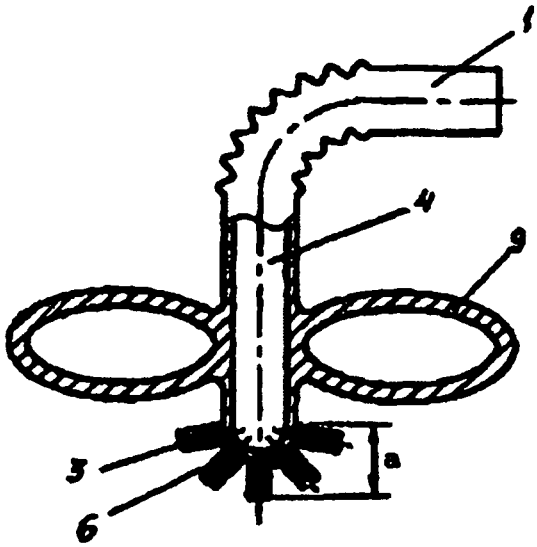
FIG. 4 shows the straw with a fan shaped branches of tubing for the intake of the drink and where the extruded part is donut shaped

FIG. 4 shows another possible design for the drinking straw. In the lower end 5 of the part 2, there are provided multiple groups of individual thin tubes or tubings 6 extending outwardly therefrom to define a fan shaped formation. More specifically, individual tubes 6 in each group extend outwardly from the end 5 of the straw. They are flexible and have holes 3 that are like the radial holes in FIG. 1 and FIG. 3. These tubes 6 are used for the intake of the liquid from the container and are connected to the main tube 4 of the straw 1. The length of these tubes 6 is chosen so that the drink must be sucked in at a depth of no more than 15 mm from the top of the liquid. The tubes 6 can be in one plane that intersects the vertical axes 7 of the straw 1 or in many planes that also intersect the vertical axes 7 of the straw. The holes 3 in the tubes 6 should have a greater combined area than the cross-sectional area of the main tube 4 in the straw 1.

It is preferable to have the inside of the main tube 4 and the holes 3 in the tube 1 and the fan shaped tubing 6 covered (coated) with silver or another substance that would optimally adjust the water properties in the drink. In the design with the fan shaped tubes 6 there will be more internal surface area that will be available for coating by silver or other chosen materials which will result in a more noticeable effect on the passing water. In this situation the drink will be more potent.

Figure 5:
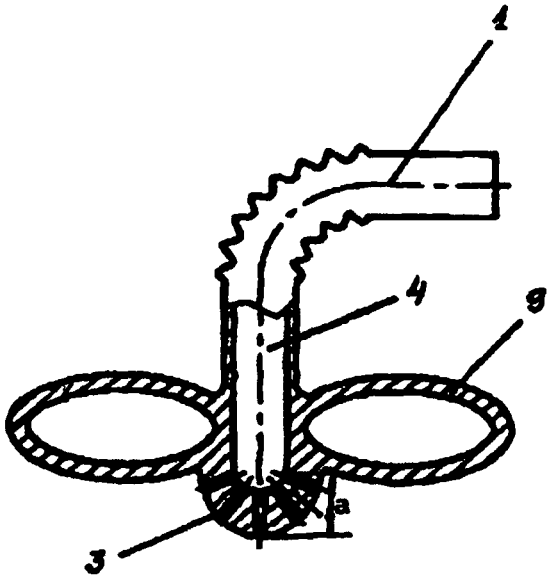
FIG. 5 shows the straw which has the lower end of the straw made from a porous material and the extruded part is donut shaped

In FIG. 5 the picture shows that the lower end of the straw 1 can be made from a porous material, whose pores will form holes 3 for the intake of the drink from the container that are connected to the main tube 4 of the straw 1. The end of the straw has to be made so that the intake of the liquid occurs at a depth of no more than 15 mm.

A very important part of the proposed straw is the device 8 that positions and holds the straw in the drink in a way that water intake openings 3 are submerged at the certain predetermined depth. The device 8 is located above the system of holes 3 at a very strictly maintained distance from the holes. This distance is chosen so that it follows the following rule: during the intake of the liquid from the container, the lower part 2 of the straw 1 with the holes 3 must constantly remain in the upper regions of the drink, whose depths do not exceed 15 mm from the top of the drink. So with the device 8 optimally positioned on the straw 1 the person using the straw only draws liquid from the upper regions that are located at the depth of 15 mm but do not to exceed 20 mm. In addition, the holes 3 on the lower part 2 of the straw 1 (either as radial holes on the sides of the lower part 2, or the holes 3 in the fan shaped tubes 6 on FIG. 4, or holes 3 that are formed by the pores of the porous material that composes the lower part of the straw on FIG. 5) are designed and positioned in such a way that allows for an equal and steady intake of the drink from the upper layers of the drink from all directions, which will create a laminar flow of the drink from the certain required depths. This is a principal difference from the prior art straw designs such as JP 2005013684, which causes a turbulent flow and DE 20 2006 000 080 U where the intake of the water occurs through a central hole; both of which these do not exclude the possibility that the straw will take in the drink from other lower levels.

The preferable depth of the top layer from where the drink is taken from is 5-15 mm from the top the drink but not to exceed 20 mm and therefore the position of the device 8 on the straw is determined by the need to meet that condition.

There are many ways to create the device 8 that will hold the straw in place. However all iterations must allow for the holes 3 to always be in the top layer, where the activity of the water is lowest in comparison to the other layers, in terms of its effect on living cells.

In FIG. 1 through FIG. 6 the different embodiments of the device 8 are based on the assumption that this is made from an element that will float on top of a water based drink. Due to its buoyancy, the device 8 is always on top of the drink in the container. As the user sucks out some of the liquid, the water level drops. However since the device 8 is floating on top of the water it goes down with the water, allowing for the same upper layer of the drink to be taken in every time. To have the water taken in at the preferred depth of 5 mm-15 mm all of the holes 3 will always need to be in the upper layers of the water from 5 mm to 15 mm depth which is noted as "a" in FIGS. 1,4,5,6 In addition, the distance between the upper hole in the system of openings 3 and the bottom part of the floating device 8 needs to be chosen in such a way that openings 3 will draw the drink into the straw preferably from the depth of 5 mm but no less than 2 mm.

Figure 2:
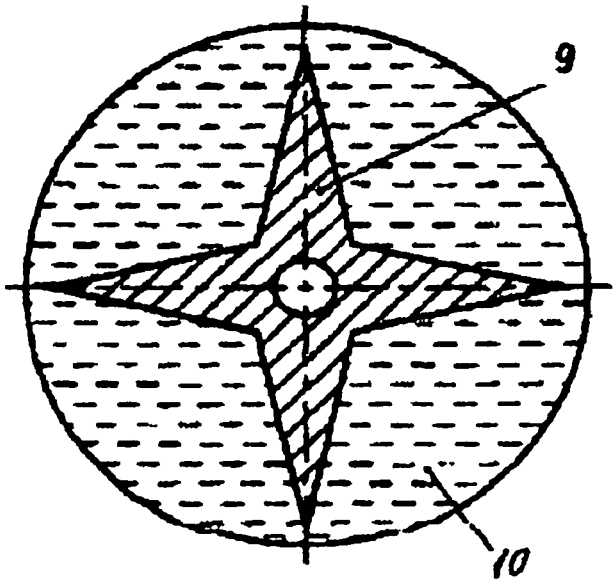
FIG. 2 shows cross-section of device in FIG. 1

In another embodiment of the invention the device 8 completely or partially is made out from ice. FIG. 1 and FIG. 2 show one of the possible variants where disc made of ice is affixed to the extruded part 9 of the device 8. In another embodiment the ice disks can be made and stored separately from the straw and then affixed to the straw right before it is to be used. Such pieces of ice 9 can be made in any form, including that of a disk. Colorful images made from food coloring or additives can be incorporated in the body of the ice. The ice disk can be made of many layers, where each layer would add its own taste to the drink. Each layer can also have its own picture. As the ice would melt, the ice would seem to have a never ending show of images or even animation. Volume, thickness and shape of the ice disc, as well as geometry of other elements of the straw have to be chosen so that melting of the ice disc does not cause openings 3 to be out of the preferred depth range a of 5 mm-15 mm from the top of the drink. The device 8 as shown in FIG. 1 and FIG. 2 can be made with an extrusion 9 on the straw wall. This extruded part can be made from a material that will float on surface of the drink. In another embodiment of the invention shown in FIG. 3 to FIG. 6, the extrusion 9 is made as a hollow (donut shaped) body, which allows the straw to float in the drink. Alternatively, the hollow space can be filled with a substance, which floats in water and has a high heat capacity. This will allow the straw to be frozen before use, thus providing extra cooling to the drink sucked in through such straw. The above described extrusion or hollow body can be shaped as a disc, star or any other shape.

The extrusion 9 can have any shape. Furthermore, a new shape for the extrusion 9 can be another reason for someone to choose to use this straw. One of the many possible geometrical forms of the extrusion 9 can be in the shape of a cup that is facing the top of the water, while the lower end of the straw has a place to attach or impale an ice disk. This alternative embodiment allows for the possibility of regulating the speed at which the ice melts, while satisfying the previously stated requirements for the drink intake depth range. It is also possible to have a cup that is removable from the straw. The freezing of the water in such a cup shaped form can be done without it being attached to the straw as the straw and cup are attachable when needed as there is a groove or small extrusion to support it. When such a straw will float in the drink, a layer of melt water will be formed at the top of the drink. This addition of melt water will lower the activity levels of the water in the top layer sucked up by the user.

The lower submerged in the drink part 8 may be covered (coated) with silver, gold platinum, food additives or another wettable substance that would optimally adjust the properties of the water in the drink.

Figure 6A:
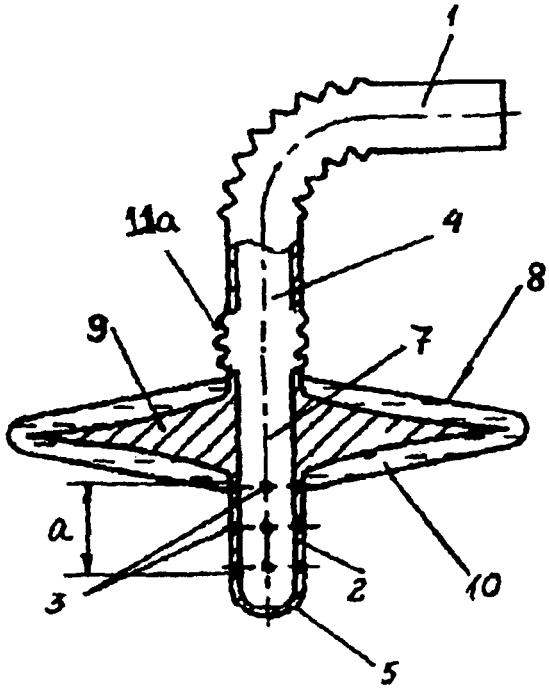
FIG. 6A shows the straw which has flexible connection area between the upper tube part of the straw and the floating extruded part.
Figure 6B:
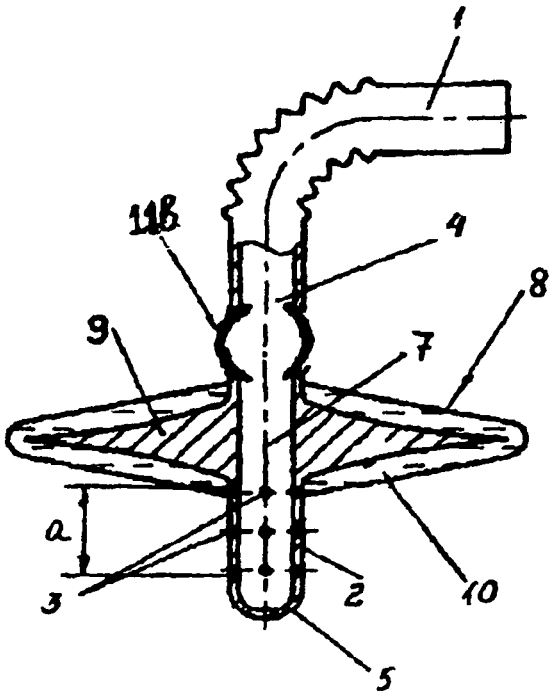
FIG. 6B shows the straw with a joint type connection area between the upper tube part of the straw and the floating extruded part.

Turning now to FIG. 6A and FIG. 6B which illustrate the connection area between the upper tube part of the straw and the floating extrusion part 8 is to be made either flexible 11*a* or in the form of a joint 11*b* which will allow the upper part of the straw 1 to be at any angle to the floating extruded part without pushing the floating part 8 out of the drink thus keeping openings 3 in the preferred depth range a of 5 mm to 15 mm.

Figure 7:
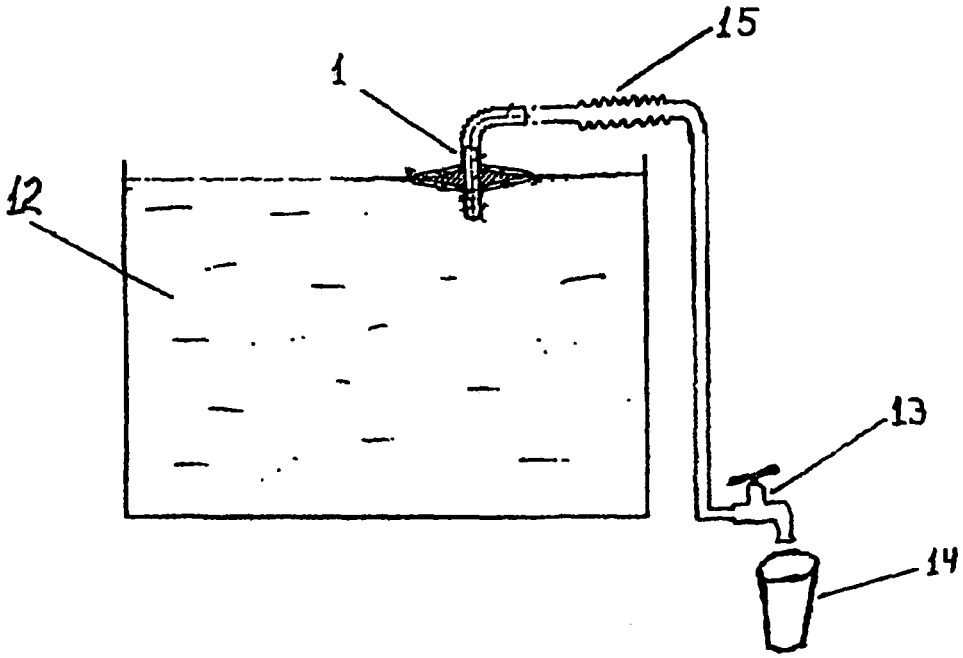
FIG. 7 shows a larger storage-type drink container equipped with floating "straw" type device that allows filling the individual containers (glasses) with the less active water.

FIG. 7 illustrates yet another embodiment of the invention that shows the straw type floating device 1, designed to extract drinks from a preferred depth of 5 mm to 15 mm, incorporated into a large drink storage container 12 used in restaurants, bars or in other multi user settings. Floating device 1 through a pipe 15 is connected with a valve 13, which is used to fill in the individual containers (glasses) 14 for end users.

The invention claimed is:

1. A drinking straw arrangement floating on a top surface of a drink to extract a drink having minimal biological activity, said arrangement comprising:

a straw having a side wall extends between proximal and distal ends thereof;

a flotation device having a core portion defined by exterior walls thereof with a hollow space formed within the core portion; said straw passing through the exterior walls and the hollow space, the distal end of the straw extends outwardly from the flotation device, multiple groups of individual tubings, each said individual tubing in each said group extend outwardly from the distal end of the straw, each said tubing having an intake hole passing therethrough and through said side wall at said distal end of the straw, said individual tubings extend radially with respect to a longitudinal axis of the straw to define a fan shaped formation, said tubings in the fan shaped formation are disposed within at least one plane substantially perpendicular to a plane of said floatation device, the flotation device and the fan shaped intake tubings stabilize position of the arrangement and support the straw in an upright position on the top surface of the drink, said tubings with said intake holes are submerged into the drink at an optimal predetermined distance from a bottom of the exterior wall of the flotation device.

2. A drinking straw arrangement of claim 1, wherein the intake holes of the individual tubings are located in at least one plane that is substantially perpendicular to the longitudinal axis of the straw, said intake holes are substantially equally spaced around a perimeter of the distal end of the straw.

3. A drinking straw arrangement of claim 2, wherein said intake holes are located in at least two planes, which are substantially perpendicular to the longitudinal axis of the straw, said intake holes are substantially equally spaced from each other, while the intake holes that are located in the other planes are not equally spaced from each other.

4. A drinking straw arrangement of claim 1, wherein an internal surface the intake holes of the fan shaped formation are covered by silver or another wettable substance to adjust the drink properties.

5. A drinking straw arrangement of claim 1, wherein the total sum area of the intake holes used for the intake of the drink is greater than the cross-sectional area of a main tube of the straw and at least a portion of said flotation device is made from ice.

6. A drinking straw arrangement of claim 5, wherein a picture made from a food coloring is provided inside of said ice portion of the flotation device.

7. A drinking straw arrangement of claim 5, wherein the ice portion of the flotation device is composed of at least one layer having its own flavor.

8. A drinking straw arrangement of claim 5, wherein the ice portion of flotation device is composed of multiple layers each having own image incorporated in its body, upon melting each layer shows its own image, producing an effect of animation.

9. A drinking straw arrangement of claim 1, wherein said flotation device has a shape of a disk.

10. A drinking straw arrangement of claim 1, wherein the flotation device is formed as an extrusion associated with said side wall of the straw and the floatation device is buoyant in water.

11. A drinking straw arrangement of claim 10, wherein the extrusion has at least one external side covered by a layer of ice.

12. A drinking straw arrangement of claim 10, wherein the extrusion is hollow.

13. A drinking straw arrangement of claim 12, wherein the extrusion has a donut shape that encircles the straw.

14. A drinking straw arrangement of claim 12, wherein the hollow space of the flotation device is filled with a high heat capacity substance which is buoyant in water.

15. A drinking straw arrangement of claim 1, wherein to facilitate extraction of the drink having minimal biological activity the device floats in the upright position on the top of the drink in such a manner that the drink is extracted into the straw at the predetermined depth between 5 mm and 15 mm.

16. A drinking straw arrangement of claim 1, wherein said optimal predetermined distance is between 2 mm and 5 mm.

* * * * *